US006532949B1

(12) United States Patent
McKendrick

(10) Patent No.: US 6,532,949 B1
(45) Date of Patent: Mar. 18, 2003

(54) PAINT BALL GUN KIT ASSEMBLY

(76) Inventor: Jeffrey D. McKendrick, 21833 Rain, East Point, MI (US) 48021

( * ) Notice: Subject to any disclaimer, the term of this patent is extended or adjusted under 35 U.S.C. 154(b) by 0 days.

(21) Appl. No.: 09/884,768

(22) Filed: Jun. 19, 2001

(51) Int. Cl.[7] ..... F41B 11/32
(52) U.S. Cl. ..... 124/77; 124/73; 124/75
(58) Field of Search ..... 124/58, 73, 74, 124/75, 77

(56) References Cited

U.S. PATENT DOCUMENTS

| | | | | |
|---|---|---|---|---|
| 5,727,538 A | | 3/1998 | Ellis | 124/77 |
| 5,878,736 A | | 3/1999 | Lotuaco, III | 124/71 |
| 5,881,707 A | | 3/1999 | Gardner, Jr. | 124/77 |
| 5,890,479 A | | 4/1999 | Morin | 124/31 |
| 5,967,133 A | | 10/1999 | Gardner, Jr. | 124/77 |
| 6,003,504 A | | 12/1999 | Rice et al. | 124/73 |
| 6,035,843 A | | 3/2000 | Smith et al. | 124/77 |
| 6,065,460 A | * | 5/2000 | Lotuaco, III | 124/72 |
| 6,138,656 A | * | 10/2000 | Rice et al. | 124/73 |
| 6,142,136 A | * | 11/2000 | Velasco | 124/71 |
| 6,343,599 B1 | * | 2/2002 | Perrone | 124/70 |
| 6,349,711 B1 | * | 2/2002 | Perry et al. | 124/73 |
| 6,360,736 B1 | * | 3/2002 | Juan | 124/32 |

FOREIGN PATENT DOCUMENTS

WO WO 00/75594 A1 * 12/2000

* cited by examiner

*Primary Examiner*—Charles T. Jordan
*Assistant Examiner*—John W. Zerr
(74) *Attorney, Agent, or Firm*—Young & Basile, P.C.

(57) ABSTRACT

An electro-pneumatically operated kit assembly is provided for connection to a paint ball gun body, the kit assembly having a trigger initiating a programmed electrical control unit which actuates a first solenoid valve to move a hammer to open an air distribution path to allow pressurized air into the barrel to fire a paint ball sitting within the barrel of the gun body. The first solenoid valve then closes and a second solenoid valve opens to move a bolt away from the path of projectile storage path to release the next single paint ball into the barrel to await another trigger actuation. The first solenoid valve controls the movement of the hammer while the second solenoid valve controls the movement of the bolt so that the hammer and bolt move independently from each other.

11 Claims, 3 Drawing Sheets

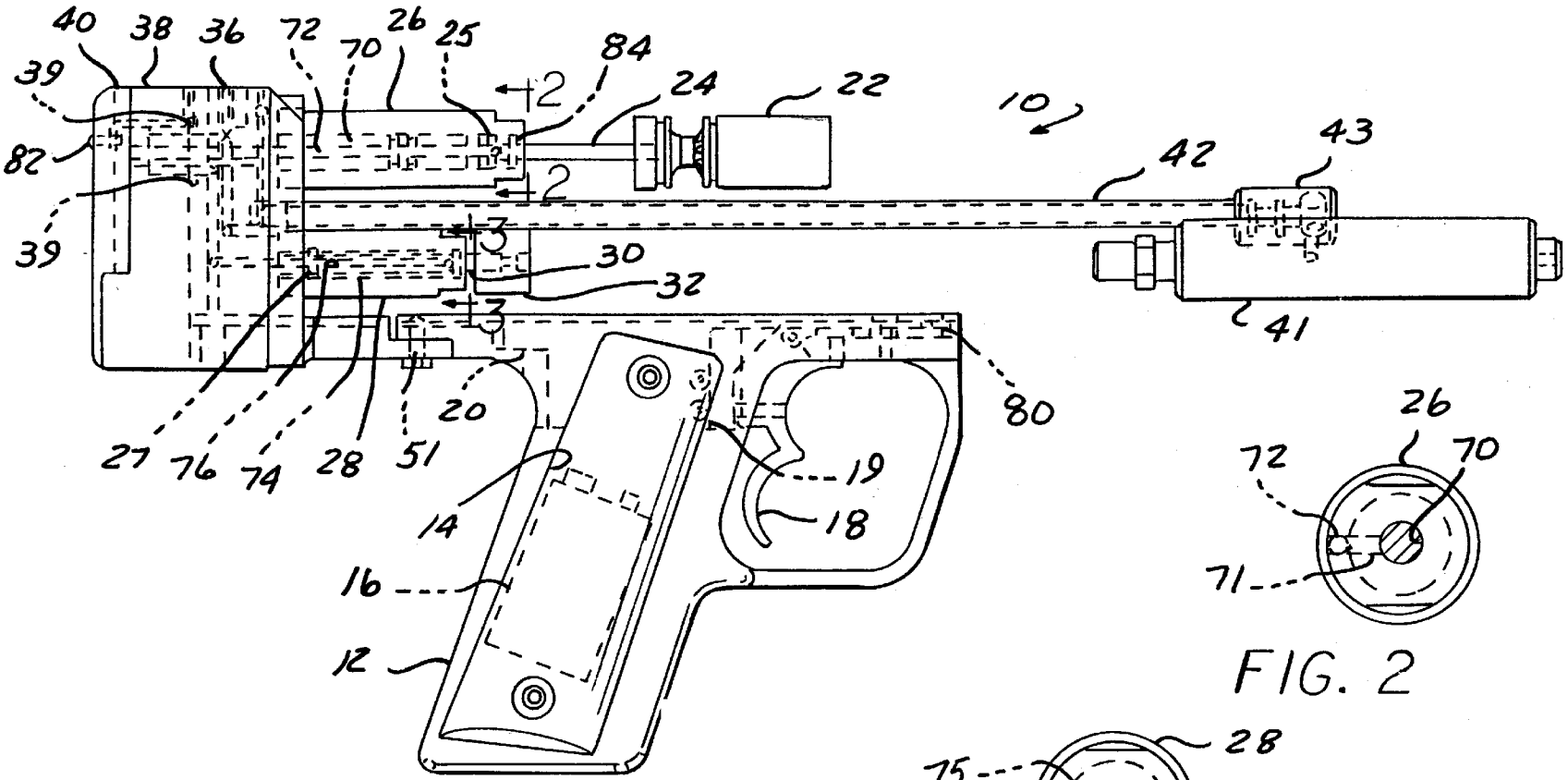
FIG. 1
FIG. 2
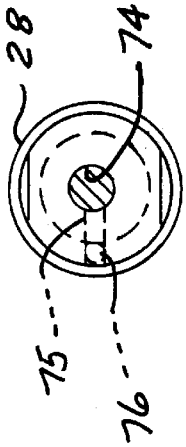
FIG. 3

PAINT BALL GUN KIT ASSEMBLY

FIELD OF THE INVENTION

The invention relates to a kit assembly adaptable for a connection to a paint ball gun body to change a mechanical pneumatically powered paint ball gun to an electro-pneumatic powered paint ball gun.

BACKGROUND OF THE INVENTION

Paint ball guns are widely used in various recreational environments, such as simulated war games wherein it is the intent to shoot an opposing member with the paint ball gut and hit the opposition with the paint ball.

Paint ball guns using compressed air or gas are well known. Until recently, most paint ball guns were mechanical pneumatically powered guns. The entry of electro-pneumatically powered paint ball guns provided a more consistently top performing device for the recreational market. An electro-pneumatic paint ball gun provides improved performance with less component malfunctions than the mechanical-pneumatic paint ball gun. The electro-pneumatic paint ball gun shoots faster and more consistently in a lighter and more compact package than the mechanical pneumatic paint ball guns.

The cost to purchase the new electro pneumatically powered paint ball guns can be high. It would therefore be desirable to provide a paint ball kit assembly which could be simply retrofitted onto an existing paint ball gun body that would change a mechanical pneumatically powered paint ball gun into an electro-pneumatically powered paint ball gun easily and at a significant cost savings. The current electro-pneumatically powered paint ball guns are specifically manufactured to fit with a specific paint ball gun body. The electro-pneumatic system on existing electro-pneumatically powered paint ball guns can not be easily adapted to the current "over and under" bore design of the mechanical-pneumatically operated paint ball guns.

SUMMARY OF THE INVENTION

The invention addresses the aforementioned concerns by providing an electro-pneumatically operated paint ball kit assembly for connection to a paint ball gun body and especially a paint ball gun body having an "over and under" bore design. A paint ball gun body has a barrel for receiving a paint ball and a cylindrical bore located parallel to the barrel and directly below the barrel. There is a through passageway between the barrel and the bore. A feed inlet connected to a supply of paint balls is open to the barrel. The electro-pneumatically operated kit assembly comprises a moveable bolt configured for disposition and movement within the barrel for selectively sealing and unsealing the feed inlet. A first valve means is provided for positioning the bolt to seal the feed inlet when the first valve means is deactivated and to unseal the feed inlet when the first valve means is activated. The electro-pneumatically operated assembly further comprises a moveable hammer configured for disposition and movement within the cylindrical bore and for selectively sealing and unsealing the through passageway. A second valve means is provided for positioning the hammer to seal the through passageway when the second valve means is deactivated, and to unseal the through passageway when the second valve means is activated. Means is provided for selectively activating each of the first and second valve means independently.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and FIG. 1 is a side elevation view of the paint ball gun assembly according to the present invention showing certain interior components in phantom;

FIG. 2 is a sectional view taken along lines 2—2 in FIG. 1;

FIG. 3 is a sectional view taken along lines 3—3 in FIG. 1;

DETAILED DESCRIPTION OF THE PREFERRED EMBODIMENT

Figure 4:
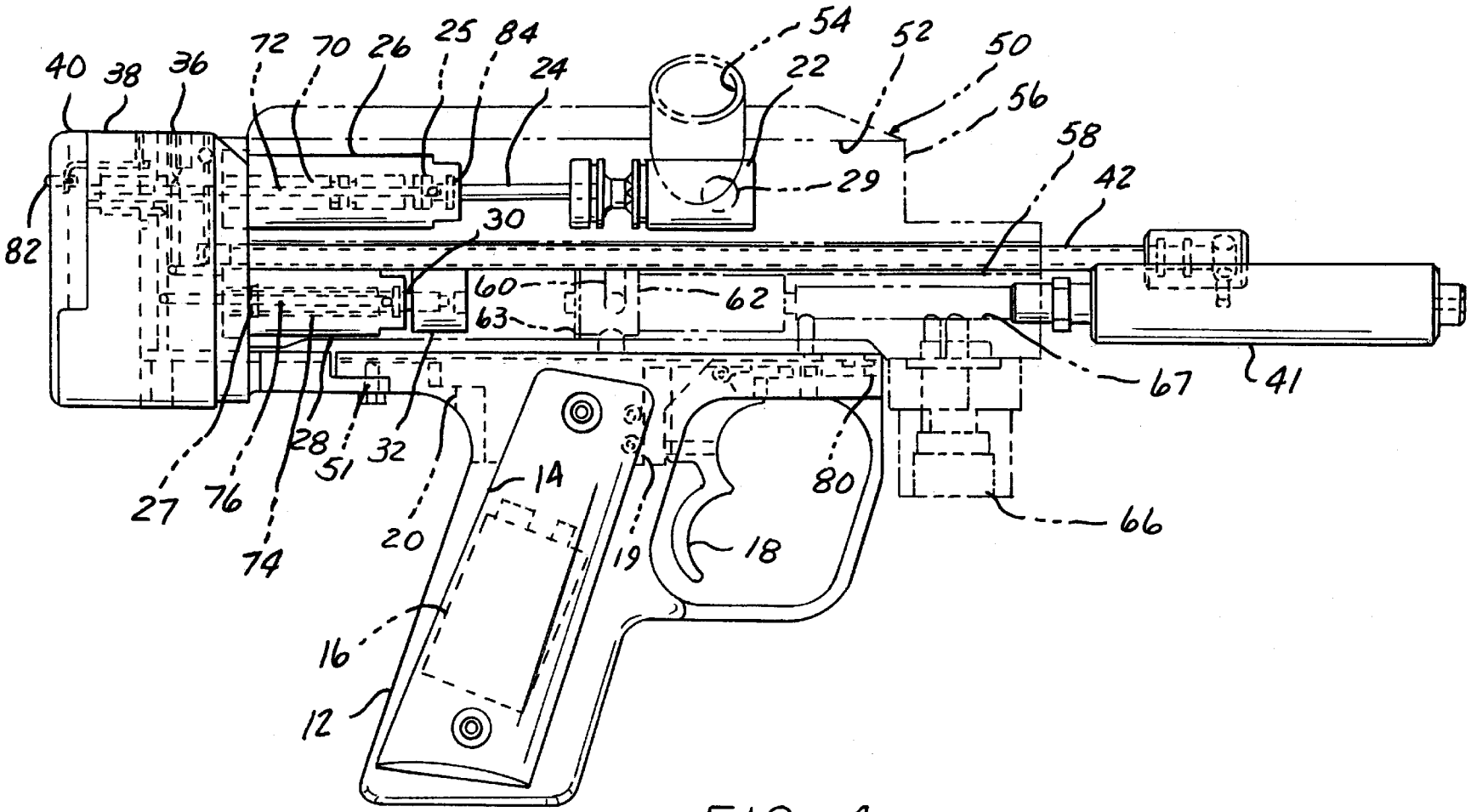
FIG. 4 is a side elevational view of the paint ball gun assembly according to the present invention connected to a paint ball gun body shown in phantom.

Referring to FIGS. 1 and 4, the paint ball kit assembly 10 includes a handle frame 12 having a hollow interior 14 for housing an electrical source such as a battery 16. The assembly further includes a pivotally mounted trigger 18, a microswitch 19 and a programmed circuit board 20. The microswitch 19 is activated by the pull of the trigger 18 and thereby actuates the programming cycle as specified in the programmed circuit board 20.

The assembly further includes a bolt 22 having a generally cylindrical configuration and positioned on one end of a rod 24 which is slidably secured in a center cylindrical aperture 70 in a first cylinder 26. The rod 24 has a piston 25 on the other end. The rod 24 is extendable beyond the first cylinder 26. A second cylinder 28 having an associated rod and hammer 30, 32, respectively, are positioned parallel and below the cylinder 26 and bolt 22. The hammer 32 is connected to the rod 30 at one end. The other end of the rod 30 is slidably secured to a piston 27 within a center cylindrical aperture 74 in the second cylinder 28 such that the rod 30 is extendable beyond the second cylinder. The piston, rod and hammer 27, 30, 32, respectively have reciprocal movement relative to cylinder 28. As will be discussed hereinafter the bolt 22 has reciprocal movement for selectively opening and closing an access inlet 29 into the gun body 50 for a paint ball. The hammer 32 has reciprocal motion to selectively open and close a fluid passageway 60 for the high pressure gas to pass into the barrel 52 and thereby propel the paint ball out of the gun.

The paint ball kit assembly 10 further includes an air passage distribution system 36 having separate solenoid valves 38, 40 for independent air distribution control to the bolt 22 and hammer 32 respectively. Each cylinder includes air passageways communicating with the air passage distribution system 36 to selectively move the associated rod along with its bolt or hammer. Cylinder 26 has a center cylindrical passageway 70 and offset passageway 72 communicating with each other via path 71 and with the rod 24, as shown in FIG. 2. Cylinder 28 has a center cylindrical passageway 74 and an offset passageway 76 communicating with each other via path 75 and with rod 30 as shown in FIG. 3. The center cylindrical passageway 70 and 74 also slidably receive rod 24 and 30 respectively. The paint ball kit assembly 10 further includes an air supply regulator 41 and a supply line 42 communicating to the air passage distribution system 36. An air supply line fitting 43 connects the regulator 41 to the supply line 42.

The paint ball kit assembly 10 is connected to a typical paint ball gun body 50 by a retaining bolt 51 as seen in FIG. 4. The paint ball gun body 50 has an axially extending first bore or barrel 52 for receiving cylinder 26 and its associated bolt 22 and rod 24. The bore 52 communicates with a paint ball hopper 54 connected to a supply reservoir (not shown) of paint balls via a feed inlet 29. The bore 52 also has an open end 56 for the paint ball exit upon firing. The gun body 50 includes a second axially extending bore 58 essentially parallel to the bore 52. An air passage 60 communicates bore 58 with the bore 56. A valve assembly 62 is normally closed to block the flow of air through passageway 60. The valve assembly 62 is open to allow the flow through passage 60 when hammer 32 is actuated and displaces the valve assembly 62 from its seat 63. A source of compressed air (not shown) is connectable to an air inlet 66 of the gun body 50.

Solenoid valves 38 and 40 selectively open and close the air distribution passages 36 to either retract or extend the bolt 22 and hammer 32 respectively relative to their respective cylinders 26, 28 and to route exhaust air through ports 39. The bolt 22 and hammer 32 move independently and are each controlled and actuated by their individual solenoid valve. Solenoid valve 38 controls the movement of bolt 22 and solenoid valve 40 controls the movement of the hammer 32. Pressurized air regulated to a predetermined pressure by the pressure regulator 40 is sent to the air passage distribution system 36 via the supply line 42. When solenoid valve 38 is deactivated or "off", the bolt 22 and its associated rod 24 are in the extended position. The regulated air from the supply line 42 moves through the air passage distribution system 36 and flows through center aperture 70 of the cylinder 26 and against one side of piston 25 to extend bolt 22. When solenoid 38 is activated, the bolt 22 and associated rod 24 are retracted by distributing the regulated pressurized air through passageway 72 and connecting path 71 to pressurize the other side of piston 25.

Similarly, the hammer 32 is extended and retracted by distributing the regulated pressurized air into cylinder 28. When solenoid valve 40 is deactivated or "off", the hammer 32 is in a retracted position as shown in FIG. 1. The hammer 32 is retracted by directing the regulated pressurized air from supply line 42 to cylinder 28 through passageway 76 and connecting path 75 to pressurize one side of piston 27. Then solenoid valve 40 is activated the pressurized air is distributed into passageway 74 and against the other side of piston 27 to extend the hammer 32 and its associated rod 30. Exhaust ports 39 are provided to exhaust the air from the cylinders 26, 28.

Figure 5A:
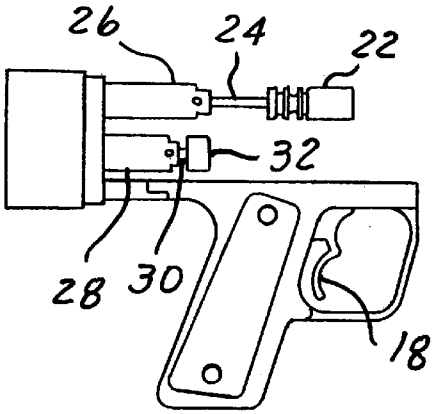
FIGS. 5A–E illustrate the movement of a pneumatically activated bolt and hammer sequence of the paint ball gun assembly when the trigger is pulled.
Figure 5B:
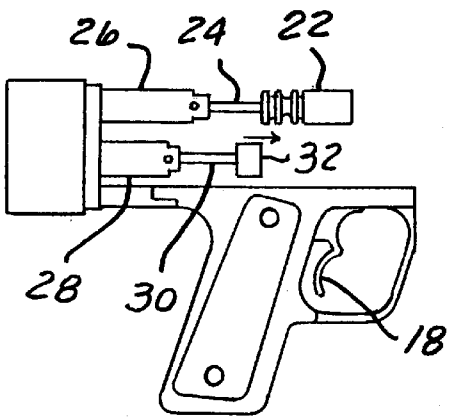

FIGS. 5A through 5E show the sequence of movements of the bolt 22 and hammer 32 during the firing process. The air supply regulator 41 of the assembly 10 is connectable to the air inlet 66 of the gun body 50 at passageway 67. Before the trigger 18 is pulled, the paint ball gun is at rest as shown in FIG. 5A, wherein the solenoid valve 38 for the bolt 22 is "off" or deactivated so that the bolt 22 is in its forward or extended position covering the paint ball inlet 29. Solenoid valve 40 for the hammer 32 is also "off" or deactivated. The hammer 32 is in its retracted position when solenoid valve 40 is deactivated.

When the trigger 18 is pulled, switch 19 is activated to send an electrical impulse to the programmed circuit board 20. The program in the circuit board 20 actuates solenoid valve 40 for hammer 32. Solenoid valve 40 directs regulated air from the supply line 42 and through the air passage distribution system 36 into the center passageway 74 of cylinder 28. The hammer 32 extends forward (the direction of arrow in FIG. 5B) by the pneumatic force on the rod 30 and hammer 32. The forward movement of hammer 32 unseats valve assembly 62 and allows the compressed air through passage 60 and into the barrel 52. If a paint ball is located within the bore or barrel 52, the force of the compressed air ejects the paint ball from the gun.

Figure 5C:
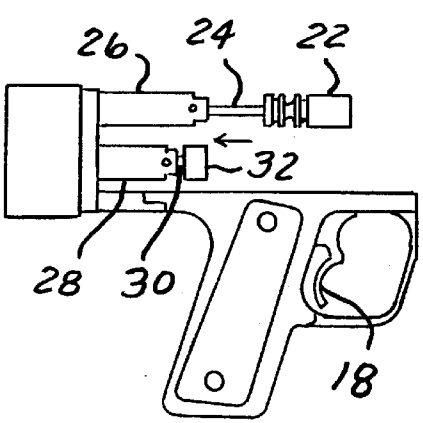

After the hammer 32 has cycled forward to unseat the valve assembly 62 to allow the passage 60 between the bore 58 and the barrel 52 to open, the program in the circuit board 20 immediately deactivates solenoid valve 40. As shown in FIG. 5C, when the solenoid valve 40 to the hammer is deactivated. The regulated pressurized air is routed through passageway 76 and connecting path 75 against piston 27 so that the hammer 32 retracts to again close the air passageway 60. During this time the solenoid valve 38 to the bolt 22 has remained deactivated so that the bolt 22 remains in an extended position.

Figure 5D:
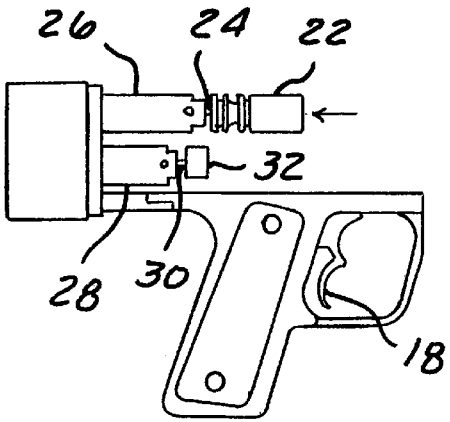
Figure 5E:
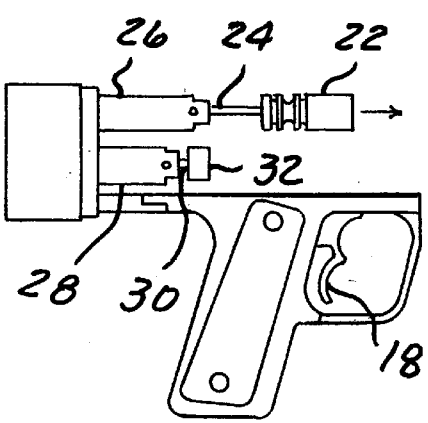

Once the passageway 60 is again closed, the program in the circuit board 20 activates solenoid valve 38 which causes the bolt 22 to retract as shown by the arrow in FIG. 5D. As the bolt 22 retracts, the paint ball inlet 29 is unseated to allow a paint ball to drop within the bore 52. When the solenoid valve 38 is activated the regulated air from the supply line 42 and into the air passage distribution system 36 is directed through the offset passage 72 and connecting path 71 in cylinder 26. The air pressure moves the piston 25 of the rod 24 along with the bolt 22 to the retracted position.

After a paint ball has dropped into the barrel/bore 52 of the gun body 50, the program in the circuit board 20 deactivates solenoid valve 38. With the solenoid valve 38 in the "off" position, the regulated pressurized air is routed in the air passage distribution system 36 to be directed into the center passageway 70 of cylinder 26. The air pressure forces the piston 25, rod 24 and bolt 22 to the extended position as indicated by the arrow in FIG. 5E. The bolt 22 extends forward to close the inlet 29. At this time, the bolt 22 also positions the paint ball for firing when the trigger 18 is again activated. This cycle is the same "ready" condition as shown in FIG. 5A so that the firing process can be repeated.

Other optional features may be provided such as a mechanical on/off switch 80 to disengage the circuit board 20 to provide a safety switch for the paint ball gun. A low power LED signal 82 may also be available to warn the user when the battery 16 charge is low. Another option is a sensor 84 which senses whether the bolt 22 is fully forward after loading a paint ball in the barrel 52, such as in the position shown in FIG. 5E. If the bolt 22 is not fully forward, the sensor 84 will signal the programmed circuit board 20 to recycle the bolt 22 before allowing pressurized air through passageway 60 and into the barrel 52. This prevents damage to the barrel if a paint ball has not fully loaded into the barrel 52, but has been caught between the feed inlet 29 and barrel 52.

The invention provides for a kit assembly that can be easily connected to a paint ball gun body having an "over and under" bore design to change a mechanical pneumatically powered paint ball gun into the more compact and better performing electro-pneumatically powered paint ball gun.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An electro-pneumatically operated kit assembly for connection to a paint ball gun body, said body having a first bore for receiving a paint ball, a second bore with a through passageway therebetween, a feed inlet open to the first bore and communicating with a supply of paint balls, said assembly comprising;

a first and second rod;

a moveable bolt connected to one end of the first rod and configured for disposition in the first bore and for selectively sealing and unsealing the feed inlet;

a moveable hammer connected to one end of the second rod and configured for disposition in the second bore and for selectively sealing and unsealing the through passageway between said first and second bores;

means for selectively moving the bolt within the first bore and means for selectively moving the hammer within the second bore, wherein said bolt and hammer move independently relative to each other, wherein the means for selectively moving the bolt and hammer comprises a gas distribution system having a pair of solenoid valves, one of the pair of solenoid valves adapted for selectively directing pressurized air to one side or other side of said first rod for driving said bolt between an extended and retracted position, and the other of the pair of solenoid valves adapted for selectively directing pressurized air to one side or other side of said second rod for driving said hammer between an extended and retracted position.

2. The kit assembly of claim 1 further comprising a programmable circuit adapted for operating said pair of solenoid valves.

3. The kit assembly of claim 2, further comprising a trigger communicating with a switch for activating said programmable circuit.

4. The kit assembly of claim 1 further comprising a pressure regulator connectable to a supply of pressurized gas.

5. The kit assembly of claim 4, further comprising a gas supply line from the pressure regulator to the gas distribution system.

6. The kit assembly of claim 1, wherein the bolt has gas passages allowing gas to pass through the bolt to propel the paint ball through the first bore.

7. The kit assembly of claim 1, wherein another end of the first rod is slidably connectable within a first cylinder.

8. The kit assembly of claim 7, wherein the first cylinder has an axial length and a concentric passageway extending the axial length of the first cylinder and an offset passageway communicating with the concentric passageway, wherein said concentric and offset passageways communicate with said gas distribution system.

9. The kit assembly of claim 1, wherein another end of the second rod is slidably connectable with a second cylinder, wherein the second cylinder has an axial length and a concentric passageway extending the axial length of the second cylinder and an offset passageway communicating with the concentric passageway, wherein said concentric and offset passageways communicate with said gas distribution system.

10. An electro-pneumatically operated kit assembly for connection to a paint ball gun body, said body having a barrel for receiving a paint ball, a cylindrical bore parallel to said barrel and a through passageway therebetween, a feed inlet open to the barrel and communicating with a supply of paint balls, and assembly comprising:

a moveable bolt configured for disposition and movement within the barrel and for selectively sealing and unsealing the feed inlet;

first valve means for positioning the bolt to seal the feed inlet when the first valve means is deactivated and to unseal the feed inlet when the first valve means is activated;

a moveable hammer configured for disposition and movement within the cylindrical bore and for selectively sealing the unsealing the through passageway;

second valve means for positioning the hammer to seal the through passageway when the second valve means is deactivated and to unseal the through passageway when the second valve means is activated;

means for selectively activating each of the first and second valve means independently.

11. The kit assembly of claim 10 wherein the means for selectively activating the first and second valve means includes a programmed electronic circuit.

* * * * *